US007111336B1

(12) United States Patent
Lai

(10) Patent No.: US 7,111,336 B1
(45) Date of Patent: Sep. 26, 2006

(54) REINFORCED DESIGN OF BATHROOM WALL MOUNTED RACK CONNECTOR

(76) Inventor: Ming-Hsiao Lai, No. 8, Lane 2, Kung Chi Village, Ta Tsuen Hsiang, Chang-Hua Hsien (TW)

( * ) Notice: Subject to any disclaimer, the term of this patent is extended or adjusted under 35 U.S.C. 154(b) by 142 days.

(21) Appl. No.: 10/791,380

(22) Filed: Mar. 3, 2004

(51) Int. Cl.
*A47K 3/12* (2006.01)

(52) U.S. Cl. ..... 4/576.1; 211/105.1; 248/309.1; 248/251

(58) Field of Classification Search ..... 4/576.1; 211/105.1; 248/309.1–309.2, 251, 222.14, 248/220.21
See application file for complete search history.

(56) References Cited

U.S. PATENT DOCUMENTS 3,023,992 A * 3/1962 Tisdall ..... 248/251
6,651,830 B1 * 11/2003 Pan ..... 211/105.1

* cited by examiner

*Primary Examiner*—Charles E. Phillips
(74) *Attorney, Agent, or Firm*—Egbert Law Offices

(57) ABSTRACT

A bathroom wall mounted rack has mounts with a wall end as one end; holes set on the wall mount, and in the center one frame is perforated to the wall end. Through holes are set on the connector end of frame in the condition of radial transfixion, and the two ends of through hole are corresponding to the fillisters of wall mount. Bolts go through the through hole of frame connector end, the two ends protrude on two sides of frame connector ends and further embed into two fillisters of wall mount correspondingly so as to connect and fix the frame and wall mount. Therefore, the combination and orientation design of bolts will enable the frame to have an effect of firm support and orientation to actually avoid from circumvolution, loose and split so as to meet the advancement requirements of more firmness and durability.

2 Claims, 6 Drawing Sheets

REINFORCED DESIGN OF BATHROOM WALL MOUNTED RACK CONNECTOR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a bathroom wall mounted rack, and more particularly to a wall mounted rack which is connected to the wall by a bolt for mounting.

BACKGROUND OF THE INVENTION

There are different functions of bathroom wall racks according to different frame patterns, such as towel rack, tissue rack, soap rack and handle rack, etc. The improvement made in this invention is a structure, in which the frame of bathroom mounted rack is connected with the wall mount. As for the traditional structure, the frame of bathroom wall mounted rack is generally connected with the wall mount by means of bolting, jointing and riveting. As a matter of fact, these connecting means are comparatively insufficient to the radial orientation of the connector end of frame. While because the bathroom wall rack generally becomes a handle for people casually in a bathroom, especially at the moment people are going to slip, the action of hands on the wall rack is so powerful that parts of bolting, jointing and riveting between the wall rack frame and wall mount mentioned above are usually likely to unscrew or split. At the other angle, it is required in design to take supporting strength of a handle rack into consideration. In a purpose of time saving and efficient assembling, practitioners gradually tend to adopt the structure of single wall mount with curvilinear handle racks. Therefore, the combining strength between the frame and wall mount of the structure becomes an important key. The prior structure by means of bolting, jointing and riveting is unable to meet the requirement of this structure due to insufficiency in radial supporting strength.

Based upon the aforementioned disadvantages of conventional bathroom wall rack, this industry shall assume the responsibility to make pioneering R&D and innovation for an ideal utility model.

BRIEF SUMMARY OF THE INVENTION

The developed functions of this invention are as follows:

1. It provides an innovated bathroom wall mounted rack combined and orientated by means of bolt 30 traverse between the connector end 21 of frame 20 and the wall mount 10, which is really a new invention in the industry and meets the requirements of novelty of new model patents.

2. With combination and orientation by means of bolt traverse, it can actually improve the disadvantage of the prior wall rack that is easy to unscrew or split because the frame and wall mount are connected by means of bolting, jointing and riveting. The structure that two connector ends are embedded in fillister of wall mount 10 by means of bolt 30 traverse through frame 20 connector end 21 will enable the frame to have an effect of firm support and orientation to actually avoid the frame from circumvolution, loose and split so as to meet the advancement requirements of more firmness and durability.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
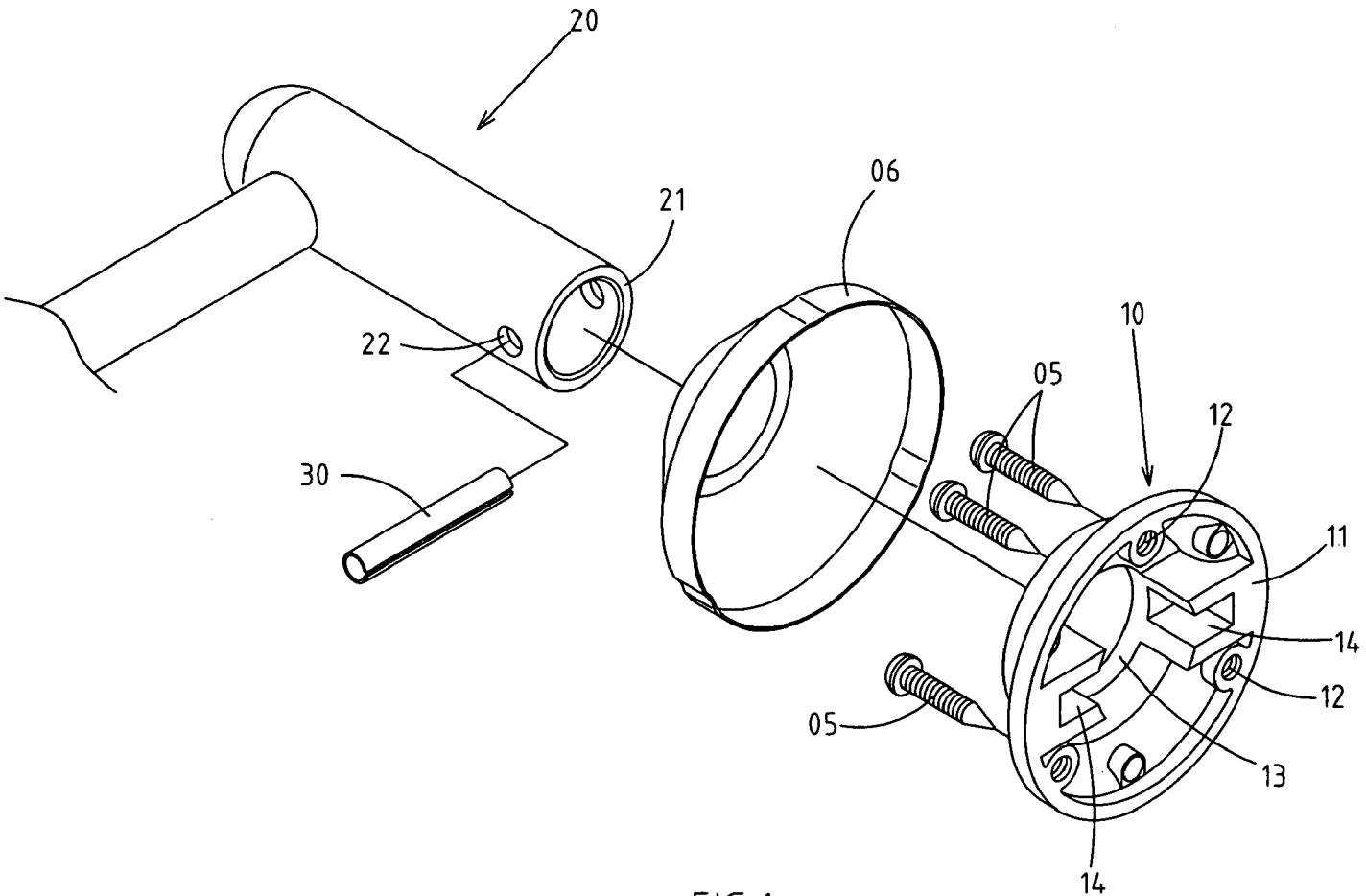
FIG. 1 shows a perspective view of the present invention.
Figure 2:
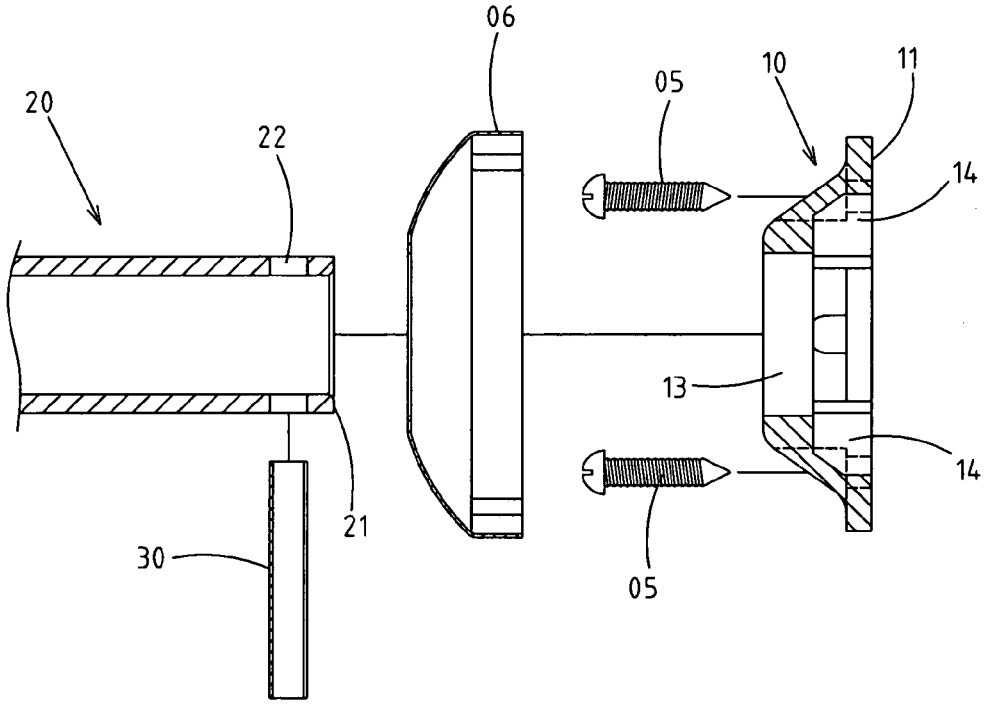
FIG. 2 shows an exploded perspective view of the present invention.
Figure 3:
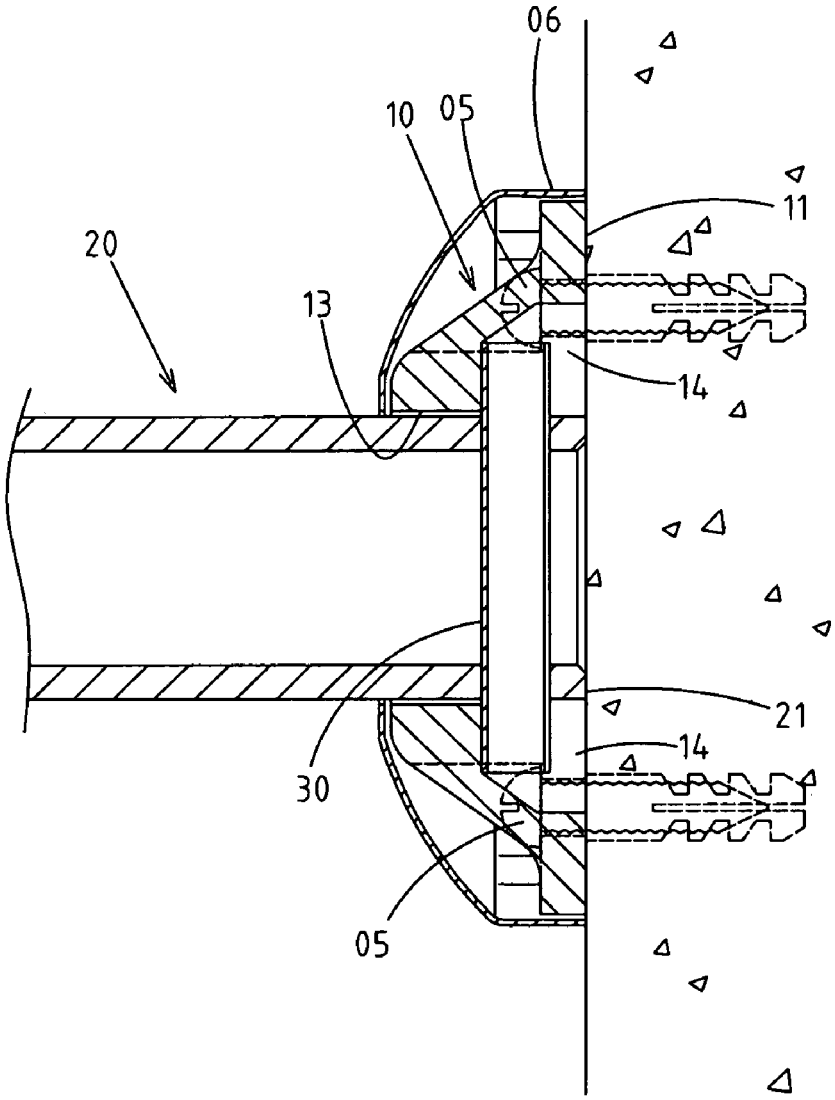
FIG. 3 shows a cross-sectional view of the present invention.

As shown in FIGS. 1–3, there is a bathroom wall mounted rack embodied in the present invention.

The present invention includes a wall mount 10, with wall end 11 providing a surface at one end. Holes are set on the wall mount 10 and fixed on the wall end by bolts 05. In the center of wall mount, one frame is perforated by frame holes 13 extending to the wall end 11. In addition, a cover 06 may be set on the outside in front of wall mount 10 to conceal different bolts in a purpose of esthetics.

There is also a fillister 14, formed on two opposite sides of the wall end 11 of wall mount 10 and the frame hole 13.

The present invention also has a frame 20, without fixed pattern, such as towel rack, tissue rack, soap rack and handle rack, etc. The connector end 21 of frame 20 just goes through the frame holes 13 on the frame in the center of wall mount 10 mentioned above.

There is a through hole 22, set on the connector end 21 of frame 20 in the condition of radial transfixion. The two ends of through hole 22 are corresponding to the fillisters 14 of wall mount 10;

The invention further includes a bolt 30 going through the through hole 22 of frame 20 connector end 21. The two ends protrude on two sides of frame 20 connector ends 21 and further embed into two fillisters 14 of wall mount 10 correspondingly so as to connect and fix the frame 20 and the wall mount 10.

Figure 4:
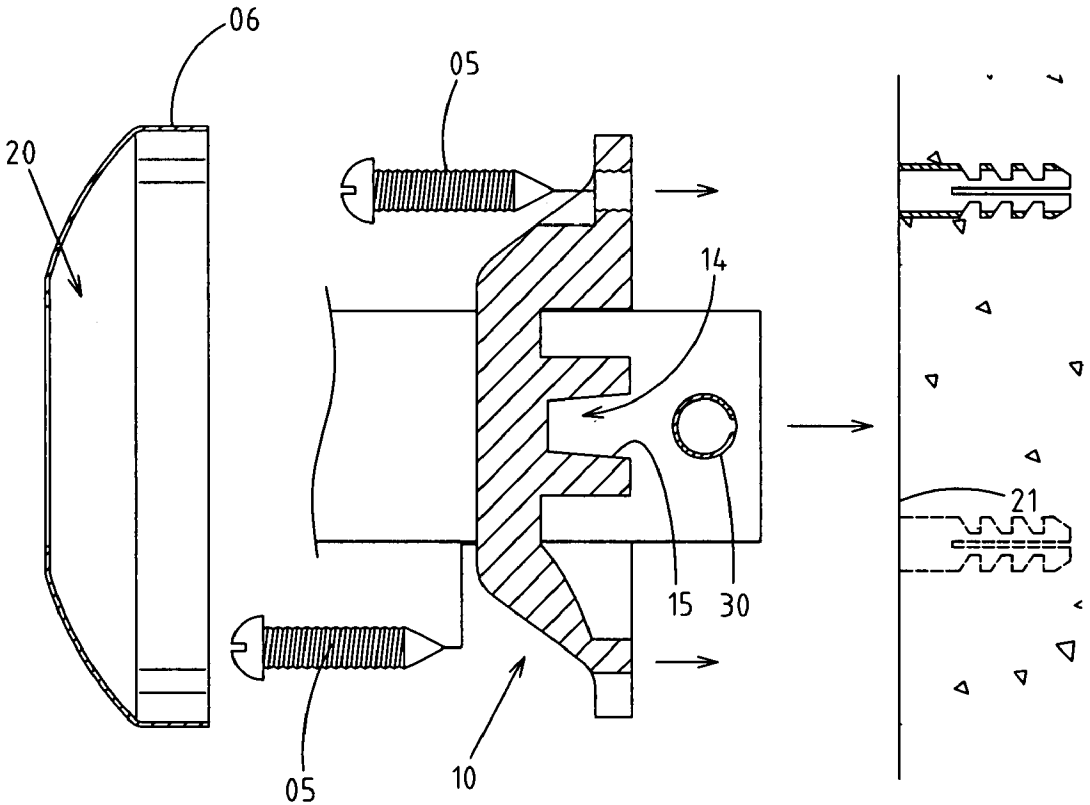
FIGS. 4–5 show the cross-sectional views of another lateral of bolt and fillister.

The fillisters 14, formed on wall mount 10, comprise a sidling taper or side walls that taper away from the surface 11, as best viewed in FIG. 4.

Figure 5:
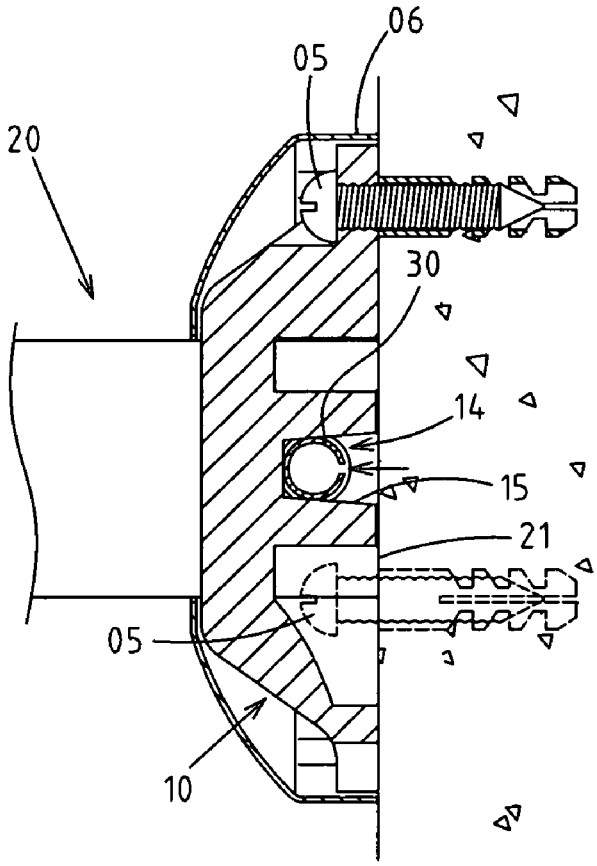

Moreover, among which, the bolt 30 is in a structure of hollow tube with C-shape cross section, which makes the outside diameter of the bolt 30 elastic so as to be fixed in the fillister tightly. In addition, when this kind of bolt 30 is embedded into the fillister 14 of sideling taper 15 with side walls mentioned above Please see FIGS. 4 and 5, and the wall mount 10 is fixed on the wall end, this bolt 30 will be wedged in the direction of the sideling taper 15 tip of fillister 14. The further it is wedged, the tighter it gets, and therefore it is more fixed in orientation.

Figure 6:
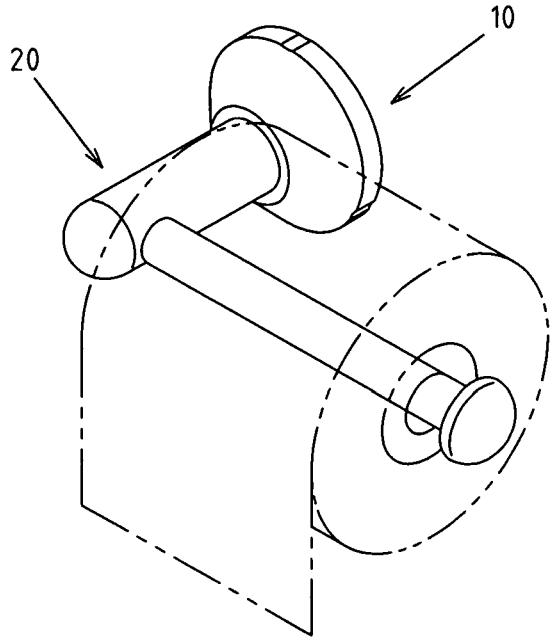
FIGS. 6–7 show perspective views of the assembled bathroom wall mounted rack.
Figure 7:
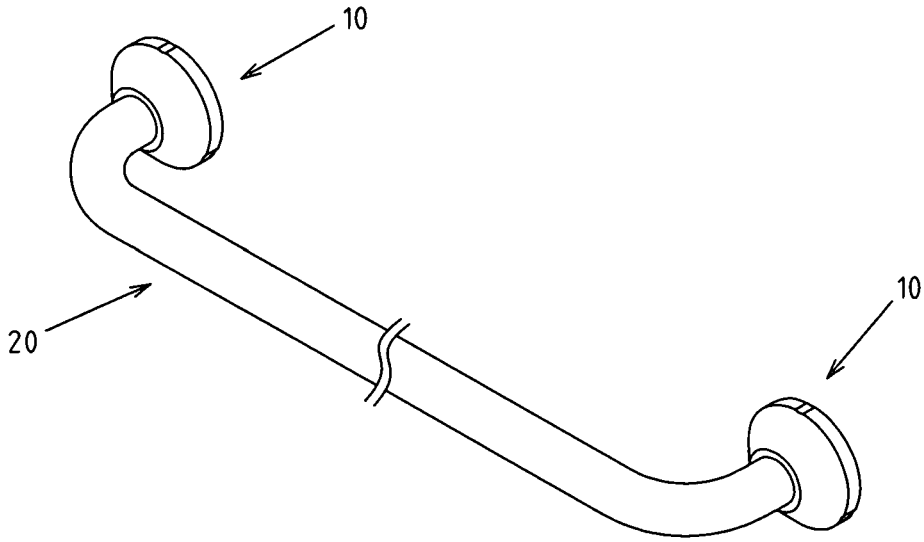

Among which, the bathroom wall mounted rack uncovered in this invention may be in a structure of single wall mount (as shown in FIG. 6); or be in a structure of double wall mounts (as shown in FIG. 7).

With the structure and composition mentioned above, the assembling steps of connectors of the bathroom wall mounted rack uncovered in this invention are as follows:

Firstly, the connector ends 21 of frame 20 go through the frame holes 13 of wall mount 10 frame; then the bolts 30 go through the through holes 22 of the frame 20 connector ends 21; the fillisters 14 of wall mount 10 are corresponding with two ends of the bolt 30 to enable the bolt 30 to be embedded in it. Finally, the wall mount 10 may be fixed on the wall end. Meanwhile, the bolt 30 is therefore limited in certain place and the frame 20 and wall mount 10 is combined together.

I claim:

1. An apparatus comprising:

a wall mount having a surface at one end suitable for being placed against a wall, said wall mount having a central frame hole formed therethrough, said wall mount having a plurality of screw holes extending therethrough and positioned around said frame hole, said wall mount having a first fillister formed on an interior thereof on one side of said frame hole, said wall mount having a second fillister formed on an interior thereof on an opposite side of said frame hole, each of said first and second fillisters defining a space therein with side walls tapering so as to narrow away from said surface;

a frame having a connector end, said connector end extending through said frame hole, said frame having a through hole formed at said connector end, said through hole extending radially through a wall of said frame of said connector end so as to define a first opening and a second opening on diametrically opposite sides of said connector end, said first and second openings being aligned respectively with said first and second fillisters; and a bolt extending through said through holes so as to have opposite ends extending outwardly of said first and second openings, said opposite ends of said bolts embedded respectively in said first and second fillisters so as to fix said frame to said wall mount.

2. An apparatus comprising:

a wall mount having a surface at one end suitable for being placed against a wall, said wall mount having a central frame hole formed therethrough, said wall mount having a plurality of screw holes extending therethrough and positioned around said frame hole, said wall mount having a first fillister formed on an interior thereof on one side of said frame hole, said wall mount having a second fillister formed on an interior thereof on an opposite side of said frame hole;

a frame having a connector end, said connector end extending through said frame hole, said frame having a through hole formed at said connector end, said through hole extending radially through a wall of said frame of said connector end so as to define a first opening and a second opening on diametrically opposite sides of said connector end, said first and second openings being aligned respectively with said first and second fillisters; and a bolt extending through said through holes so as to have opposite ends extending outwardly of said first and second openings, said opposite ends of said bolts embedded respectively in said first and second fillisters so as to fix said frame to said wall mount, said bolt being a hollow tubular member with a C-shaped cross section, said bolt having an elastic outer diameter so as to be tightly received by said first and second fillisters.

* * * * *